United States Patent [19]

Battisti

[11] Patent Number: 4,820,099

[45] Date of Patent: Apr. 11, 1989

[54] BINDER SLIDE FAILURE PREVENTION SYSTEM

[75] Inventor: Thomas T. Battisti, Buffalo Grove, Ill.

[73] Assignee: General Binding Corporation, Northbrook, Ill.

[21] Appl. No.: 116,549

[22] Filed: Nov. 4, 1987

[51] Int. Cl.[4] ..... B42C 9/00; B42C 5/08

[52] U.S. Cl. ..... 412/37; 412/40

[58] Field of Search ..... 412/20, 38, 37, 39, 412/40; 83/67, 549, 618, 622

[56] References Cited

U.S. PATENT DOCUMENTS

| | | | |
|---|---|---|---|
| 3,060,780 | 10/1962 | Stuckens | 412/40 |
| 3,967,336 | 7/1976 | Cutter | 412/40 |
| 4,613,266 | 9/1986 | Scharer | 412/40 |
| 4,645,399 | 2/1987 | Scharer | 412/40 |

*Primary Examiner*—Frank T. Yost
*Assistant Examiner*—Paul M. Heyrana, Sr.

[57] ABSTRACT

A binding mechanism for use in binding punched and apertured material is disclosed herein. The mechanism includes a comb having teeth or tines for holding a binding element having a plastic-type backbone and curled binding fingers. A slidable hook mechanism is used to engage and uncurl the binding fingers so that the punched and apertured material can be bound thereon. The comb is mounted so as to be transversely slidable from an original position to a second position. A biasing spring is provided for returning the comb from the second position to the original position. This slidable comb cooperates in minimizing damage in the event these binding fingers are inoperatively jammed or wedged between the hook and the comb.

6 Claims, 2 Drawing Sheets

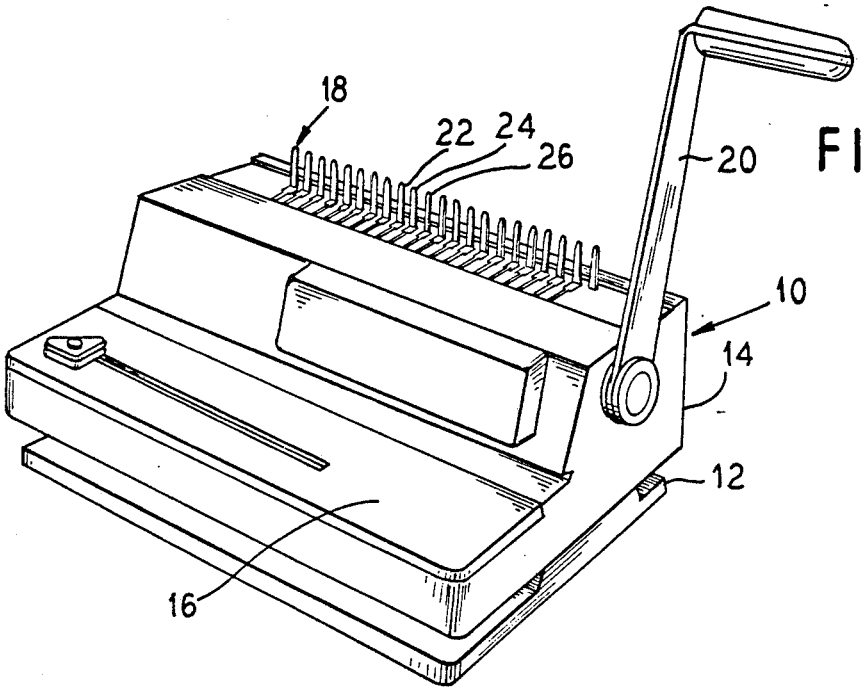
FIG. 1
FIG. 2
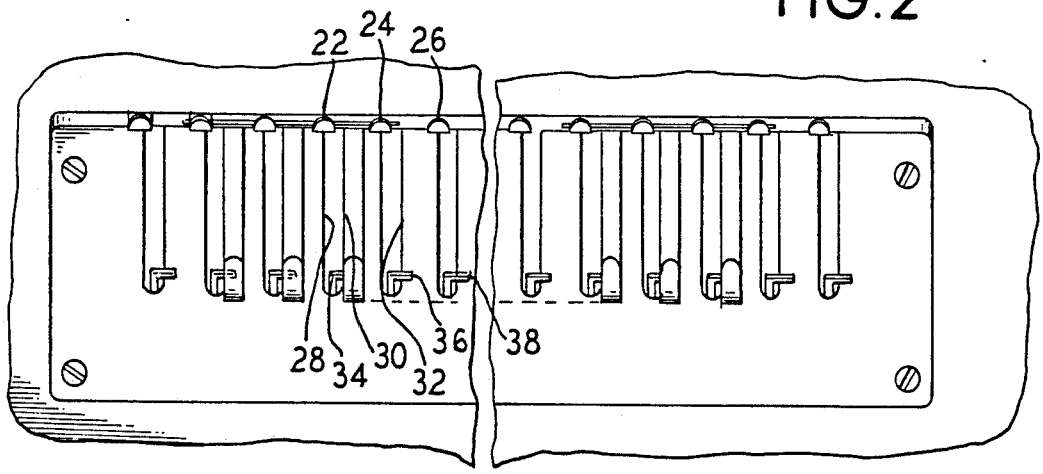
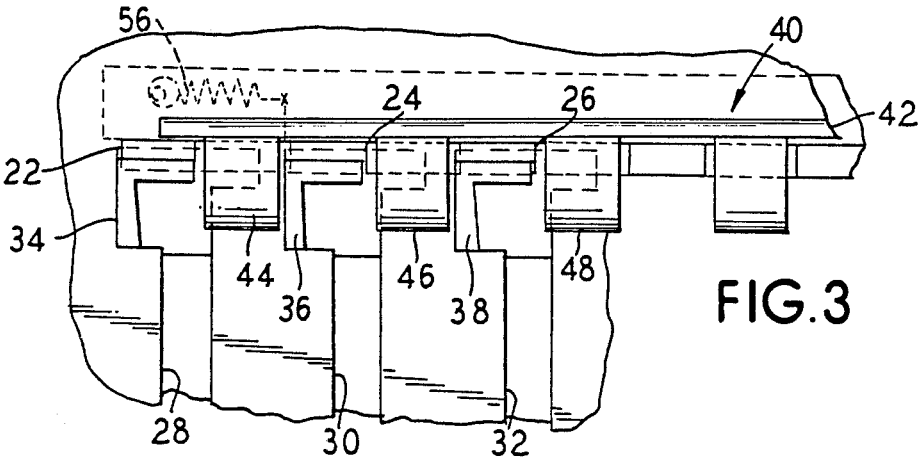
FIG. 3

BINDER SLIDE FAILURE PREVENTION SYSTEM

BACKGROUND OF THE INVENTION

This invention relates to a binding machine and more particularly to an improved binding system for comb-type binding systems.

Punch and binding machines are used for punching binding-apertures in paper, text material and/or covers and thereafter binding the punched materials with a plastic-type binder element of the type having a backbone and curled binding fingers so as to form a book, chart or the like. The binding mechanism opens or uncurls the binder element fingers so that the punched material may be impaled thereon through the binding aperture, and then bound when the fingers are released and recurl. Combined punch and binding machines and the respective operating mechanisms are known in the art and are shown in U.S. patents such as U.S. Pat. Nos. 2,603.801; 2,908,173; 3,122,761; 3,125,887, 3,227,023; 3,793,660 and 4,607,993. Binder elements are shown in U.S. patents such as 1,970,285 and 2,910,068. In these machines an upstanding binding comb is rigidly secured to the machine frame and the binding element is mounted to the comb with the backbone positioned against the backside of the upstanding comb and the curled fingers, which are to be uncurled and opened, extending forwardly between the tines or teeth of the comb. Thus, the backbone is held in place against the comb while the fingers are uncurled.

The binding machine includes a plurality of L- or J-shaped hooks which are movable (i.e. slidable) in forward and reverse directions relative to the comb by an operating lever. The hooks are also transversely slidable when positioned adjacent the comb for extending into the interior of a closed and curled finger and engaging the inside surface of a curled finger for subsequent uncurling and opening. Operation of the operating handle causes the hooks to engage the curled fingers and uncurl the curled fingers by drawing them forward. In this position the punched pages are impaled on the opened fingers. When the hooks are moved rearwardly, the fingers recurl, so as to bind the pages to the binding element. At the end of the reverse stroke the hooks slide from the curled fingers so as to release them and permit the bound book etc., to be removed from the machine by lifting the book, etc., from the comb.

In these systems the upstanding comb is rigidly mounted to the machine and it is possible that the end of the hook can engage the curled finger side edge instead of extending into the curled finger interior. This could happen as a result of machine/binding element misalignment, etc. In this case, if the operator handle is further manipulated to slide the hook transversely, the hook can jam against the side edge of the curled binder finger and force the binding element against the comb.

Since the comb is stationary, it is possible to jam or wedge the binding element between the hook and comb. The hook could be bent by further application of force through the operator handle, if the jamming is not detected. Such bending of one or more hooks is undesirable and could render the machine ineffective for binding.

It is therefore an object of this invention to provide a binding machine in which such bending is avoided or minimized.

SUMMARY OF THE INVENTION

There is provided by this invention a binding mechanism of the type described above, which is constructed to avoid or minimize bending of the finger-engaging hook. The binding mechanism is useful with binding and punching machines as described above.

The binding mechanism includes a slidable and biased comb which minimizes or avoids bending as the comb is movable and not rigidly affixed to the machine. In this mechanism, if there were a potential jam, the comb could move thereby permitting hook bending forces to be detected. The comb then returns to its original position through a biasing spring.

BRIEF DESCRIPTION OF THE DRAWINGS

FIG. 1 is a perspective view of a combined punching and binding machine;

FIG. 2 is a fragmentary top view showing an upper surface, hook assembly and comb assembly;

FIG. 3 is a diagrammatic view showing binding in normal operation;

DESCRIPTION OF THE PREFERRED EMBODIMENTS

Figure 4:
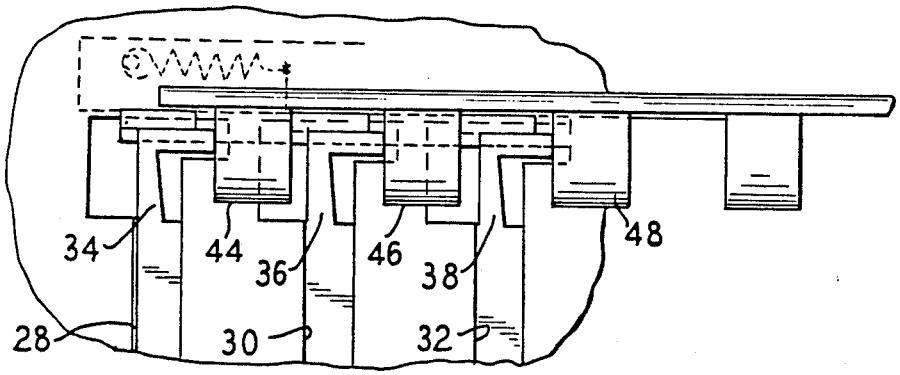
FIG. 4 is a diagrammatic view showing the initial opening and a wedged element.

Referring to FIG. 1 there is shown a combined punching and binding machine 10 which includes a base 12, a punch and binding housing and mechanism 14, a punching support surface 16, an upstanding comb 18, and an operating handle 20. Punch and binding mechanisms are known in the art as disclosed above.

The comb 18 includes a plurality of upstanding teeth such as 22, 24 and 26, and a plurality of slots such as 28, 30 and 32 in which hooks such as 34, 36 and 38 slide. The hooks are constructed to move rearwardly under the influence of the operator handle 20 toward the comb 18, slide transversely to engage a curled finger and be moved forwardly to a curled finger.

Referring to FIG. 3, the comb assembly 18 is shown with comb teeth 22, 24 and 26.

A binding element 40 is shown with the backing element 42 shown against the comb teeth curled binding fingers such as 44, 46 and 48, which are integral with the backbone 42 and extend from the backbone between comb teeth such as 22, 24 and 26. The bottom end of each finger is integral with the backbone and the top end is free although formed to the curled position. Initially each hook such as 34, 36 or 38 can be positioned in alignment with a comb tooth or tine and to the side of a curled finger such as 44, 46 or 48.

In normal operation the hook slides transversely into the finger and is then drawn forwardly or downwardly in slots such as 28, 30 or 32 to uncurl or open in the curled finger. Reversal of operation permits the finger to be closed.

In the event the end of a hook engages the side edge of a finger, as shown in FIG. 4, it pushes the finger transversely into engagement with a comb tooth. More specifically, if the end of a hook such as 34 engages a finger such as 44, it will push the backbone and element transversely and the finger into engagement with a comb tooth such as 24. This in turn causes the comb to slide transversely so as to correct the problem (i.e., engagement of the finger side) without bending the hook. If the problem is corrected, then the hook is operated to open or uncurl the finger. If not corrected the binding element can be repositioned.

Figure 5:
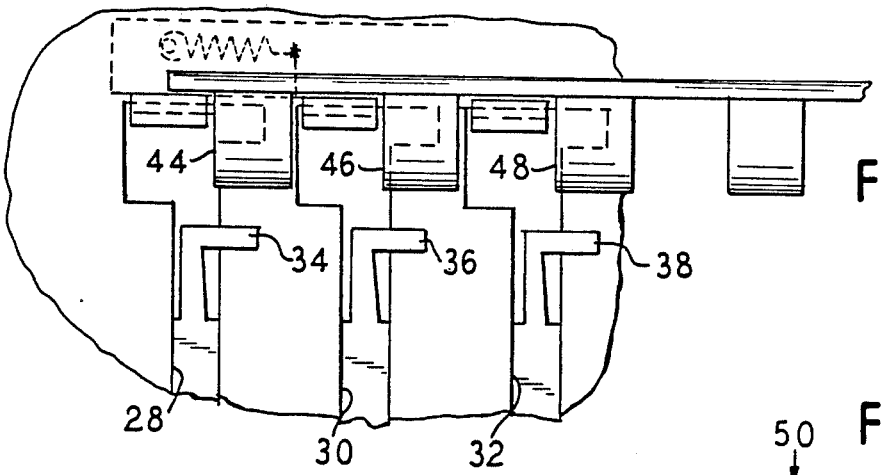
FIG. 5 is a diagrammatic view showing element release and comb return.

After the binding is completed as in FIG. 5, the comb with teeth such as 22, 24 and 26 slide, under a biasing force, back to the original position. This binding mechanism provides the ability to minimize or prevent hook bending and to correct element jamming.

Figure 6:
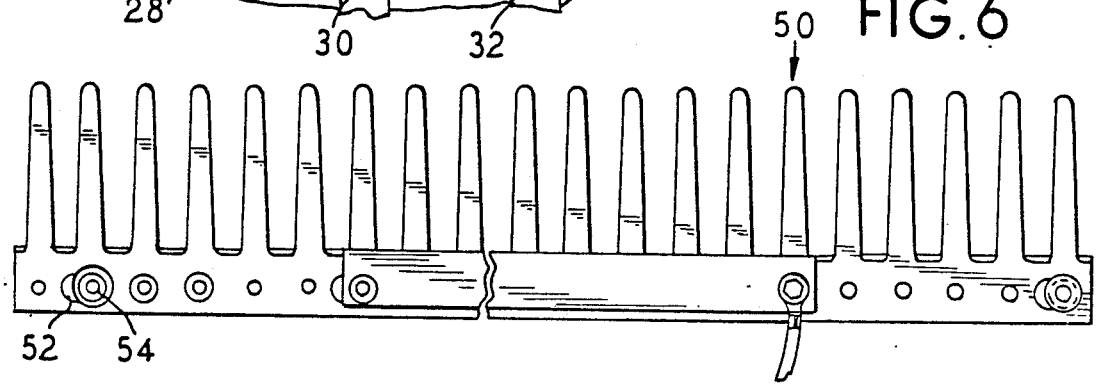
FIG. 6 is an elevational view of a slidable comb.
Figure 7:
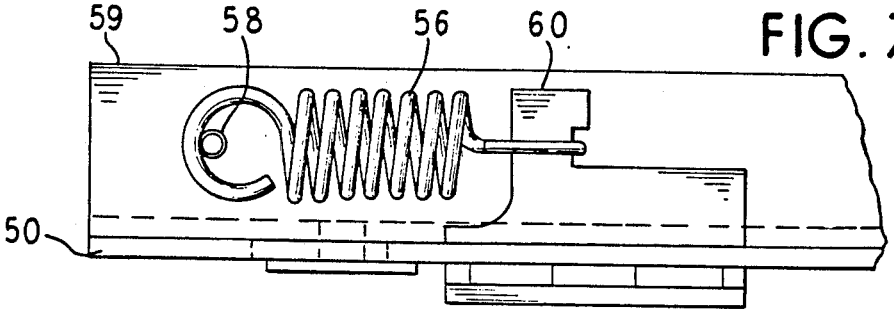
FIG. 7 is a fragmentary top view showing a spring-biasing mechanism for the slidable comb.

In FIG. 6, a comb element such as 50 is slidably mounted to the machine frame (not shown in detail) by plurality of eyelet-type constructions which include elongated slots such as 52 and a headed guidepost such as 54 as seen in FIG. 6. This eyelet construction permits transverse sliding of the comb element 50.

The element 50 is biased to its original position by a tension spring 56, which is secured at one end to a stationary post 58 mounted to the machine frame 59 and to a spring engaging flange 60, which is secured to the comb 50.

In the event of a jam a hook end pushes a binding finger against a comb tooth and in turn against the biasing permitted by the eyelet construction. Return movement of the comb is governed by the biasing force of spring 56 working in combination with the eyelet construction.

Although the invention has been described with respect to preferred embodiments, it is not to be so limited as changes and modifications can be made which are within the full intended scope of the invention as defined by the appended claims.

I claim as my invention:

1. A binding mechanism for use with an apparatus constructed to bind apertured material together with a binding element having means defining a backbone and curled aperture-engaging binding fingers, said binding mechanism including means defining a comb having spaced and upstanding tines for engaging said binding element and between which said fingers can extend, and movable hook means having a terminal end portion for engaging the interior of said fingers and opening said fingers by uncurling them from the curled position; wherein the improvement comprises said binding mechanism including slidable and biased comb means, constructed to slide from an original position to a second position in the event a hook means end engages the side edge of a finger and urges the binder element against the comb, and said comb means constructed to be biased to the original position after binding.

2. A mechanism as in claim 1 and in combination therewith, a machine having a frame and a housing and said comb means mounted transversely thereon and said comb means being transversely slidable from said original position to said second position and back to said original position.

3. A binding mechanism as in claim 2, wherein said comb means includes means defining a plurality of elongated guide slots and there are provided a plurality of guideposts constructed to engage said slot-defining means for cooperation in guiding the sliding movement of said comb means.

4. A binding mechanism as in claim 3, wherein said biasing means comprise a tension spring, said comb means including means for engaging one end of said spring and there being provided spring engaging means associated with said frame for engagement with the other end of said spring for biasing said comb means toward said original position from said second position.

5. A binding mechanism as in claim 4, wherein each of said guideposts includes a body and an enlarged head, said body being greater than the thickness of the comb member so as to assure relative sliding movement.

6. A method for minimizing damage to a binding mechanism constructed to bind apertured material with a binding element having a backbone and curled binding finger, said machine having comb means for engaging said binding element and hook means for engaging and uncurling said finger means, said method comprising the steps of:

causing said hook means terminal end to engage the side edge of at least one finger;

urging said finger into engagement with said comb means;

moving said comb means under the influence of said urging from an original position to a second position;

releasing the engagement of said hook means terminal end and said finger side edge; and moving said comb means from said second position to said original position.

* * * * *